United States Patent [19]

Knight et al.

[11] 4,340,889

[45] Jul. 20, 1982

[54] METHOD AND APPARATUS FOR COORDINATE DIMMING OF ELECTRONIC DISPLAYS

[75] Inventors: Eric M. Knight, Inkster; Edward S. Greene, Allen Park, both of Mich.

[73] Assignee: Ford Motor Company, Dearborn, Mich.

[21] Appl. No.: 175,785

[22] Filed: Aug. 6, 1980

[51] Int. Cl.[3] ..... G09G 3/00

[52] U.S. Cl. ..... 340/793; 340/789

[58] Field of Search ..... 340/793, 791, 789

[56] References Cited

U.S. PATENT DOCUMENTS

| | | | |
|---|---|---|---|
| Re. 26,119 | 12/1966 | Slater | 307/252 N |
| 3,706,914 | 12/1972 | Van Buren | 315/316 |
| 3,806,641 | 4/1974 | Crooks et al. | 340/793 |
| 3,838,209 | 9/1974 | Tsuchiya et al. | 340/793 |
| 3,876,907 | 4/1975 | Widmayer | 315/208 |
| 3,940,660 | 2/1976 | Edwards | 315/360 |
| 3,968,401 | 7/1976 | Bryant | 315/293 |
| 4,063,234 | 12/1977 | Arn et al. | 340/793 |
| 4,087,702 | 5/1978 | Kirby et al. | 307/252 B |
| 4,097,782 | 6/1978 | Chambliss | 315/209 R |
| 4,193,095 | 3/1980 | Mizushima | 340/793 |
| 4,251,755 | 2/1981 | Bryden | 340/793 |
| 4,262,290 | 4/1981 | Vallins | 340/793 |

*Primary Examiner*—Marshall M. Curtis

*Attorney, Agent, or Firm*—Paul K. Godwin, Jr.; Clifford L. Sadler

[57] ABSTRACT

A method and apparatus for adjustably activating an electronic display for selected display cycle periods defined by correspondingly selected ON time periods of activation in combination with correspondingly selected OFF time periods of activation to control the brightness level of the display at any one of a nonlinear pattern of levels.

5 Claims, 2 Drawing Figures

METHOD AND APPARATUS FOR COORDINATE DIMMING OF ELECTRONIC DISPLAYS

BACKGROUND OF THE INVENTION

1. Field of the Invention

The present invention is directed to the field of pulse width modulation techniques and more specifically to method and apparatus for adjusting appropriate modulation duty cycles when applied to devices such as electronic displays to obtain predetermined brightness levels.

2. Description of the Prior Art

Conventional approaches to control the brightness levels of electronic displays, such as vacuum fluorescent displays, are generally classified into two types.

A first type of approach involves varying the voltage or current levels applied to the display; and a second type of approach involves varying the duty factor.

The controlling of display brightness by varying the voltage or current applied thereto is generally recognized as being less acceptable, due to the non-uniform brightness that occurs at low levels and the high power requirements for the drive circuitry that must operate in a linear mode.

The varying of the duty factor, which is defined as that percentage of time the display is activated during each cycle period, is referred to as pulse width modulation and is more generally accepted as a preferable approach for controlling the brightness of an electronic display, since the problems of non-uniform brightness and high power requirements are eliminated. However, conventional pulse width modulation is limited in the number of selectable brightness level steps by the number of clock pulses present in a single cycle period. For instance, in a display system which employs "n" clock pulses per cycle period, the number of brightness level steps that may be selected is limited to "n".

Another disadvantage of conventional pulse width modulation is due to the fact that the step sizes are of equal magnitude and provide for activation of an associated display over a linear range. The linearly reduced brightness level of a display in equal brightness steps is perceived by the human eye as being a nonlinear function. Little change of brightness is perceived as the display is dimmed, until the lower end of the range is reached; and a large change in the brightness level steps is perceived at the dimmest levels.

SUMMARY OF THE INVENTION

The present invention overcomes the problems of the prior art by increasing the number of brightness level steps selectable for a fixed clock frequency and by providing a non-linear brightness control that effectively follows the response of the human eye to give a perceived linear control in the brightness adjustment range.

The discovery of this coordinate dimming technique is described in a paper entitled "Coordinate Dimming of Electronic Display" presented at the SAE Congress and Exposition, Feb. 25-29, 1980 by one of the coinventors herein. That paper is incorporated herein, by reference and describes the problems as they exist in conventional dimming techniques and their limitations. That paper further describes the observation that if one can be free from the fixed display cycle time periods of conventional pulse width modulation techniques and can select appropriate on-time periods and off-time periods to obtain desired duty factors and brightness levels, then the number of brightness level steps would not be limited by the number of clock pulses in a fixed cycle nor would the individual brightness level steps necessarily be of equal value.

By plotting brightness levels on a three axes coordinate system based upon a number of "ON" clock pulses on a first axis, a number of "OFF" clock pulses on a second axis and the resulting brightness levels for a particular display on a third axis, it is visually determinable that the number of possible coordinates or combinations of ON and OFF clock pulses is equal to $\frac{1}{2}\times(\text{Max clocks})^2$. While the above number is extremely large compared to traditional pulse modulation techniques, it does not indicate the number of unique brightness levels, since many of the possible ON and OFF clock pulse combinations result in identical brightness levels.

The number of unique brightness levels, or steps in the coordinate dimming method was calculated by plotting constant values of brightness as lines, using the relationship of:

$$\frac{\text{Brightness}}{\text{Full Brightness}} = \frac{\text{ON}}{\text{ON} + \text{OFF}} \tag{1}$$

For each brightness level line the left side of (1) can be considered a constant C. Therefore, for each brightness level the relationship of:

$$\text{OFF} = \frac{1 - C}{C} \times \text{ON} \tag{2}$$

is solved. This relationship (2) represents the equation for constant brightness lines in an ON/OFF coordinate plane. These straight lines originate from the origin and indicate unique brightness levels. The number of unique brightness levels is, of course, dependent upon the maximum number of clock pulses that one determines is available for an efficient operation of the display and the following relationship:

$$\text{No. Unique Levels} = 2 + \sum_{i=2}^{N} i\left[1 - \Sigma\frac{1}{P_J} + \Sigma\frac{1}{P_J P_K} - \Sigma\frac{1}{P_J P_K P_L} + \ldots\right]$$

where N is the sum of the ON+OFF clock pulses being considered; and J, K and L are subscripts for prime factors P of the i value taken one at a time, two at a time and three at a time, respectively.

For example: Solving for the number of unique brightness levels available for selection where the maximum display cycle period cannot exceed 8 clock pulses; N=8; and i=2, 3, 4, 5, 6, 7 and 8 for the summation.

$$\text{No. Unique Levels} = 2 + 2(1\tfrac{1}{2}) + 3(1\tfrac{1}{3}) + 4(1\tfrac{1}{2}) + 5(1\ 1/5) + 6(1 - (\tfrac{1}{2} + \tfrac{1}{3}) + 1/6) + 7(1\ 1/7) + 8(1\tfrac{1}{2})$$

$$\text{No. Unique Levels} = 2 + 1 + 2 + 2 + 4 + 2 + 6 + 4 = 23$$

(inclues full ON and full OFF levels)

A table is included in the referenced paper which indicates the maximum number of unique brightness levels that are obtainable as compared with the maximum of clock pulses available from 1–100. For instance, a system which has a maximum of 50 clock pulses available for a display cycle period allows a maximum of 774 unique brightness levels to be selected. This would compare with a maximum of 50 unique brightness levels selectable under conventional pulse width modulation techniques over equivalent brightness ranges.

The invention effectively applies the discoveries outlined in the referenced paper by utilizing a conventional potentiometer to supply an analog voltage, which may be selectably and linearly varied over a predetermined range of voltages. This range of analog voltages determines the maximum and minimum brightness for an associated electronic display. The analog voltage is converted to a digital voltage by an analog to digital converter circuit over n steps in the range. The output of the analog to digital converter is utilized to address a programmed memory that supplies digital output data in the form of respective ON and OFF time period codes corresponding to a pre-selected duty cycle for each particular brightness level that is desired over the range. The memory output is loaded into a counter which counts a number of clock pulses from a fixed frequency clock source for each ON and OFF time period. The counter ripple carry output causes a display driver to be repeatedly enabled for a first predetermined ON time period and then disabled for a second predetermined OFF time period until the analog voltage setting is changed.

It is an object of the present invention to provide method and apparatus for controlling the brightness of an electronic display for a non-linear range of brightness levels in reponse to adjustment settings in a linear range.

It is another object of the present invention to provide method and apparatus for controlling the brightness of an electronic display over a range of brightness levels that appear as linear to the human eye, in response to analog adjustments in a linear range.

It is a further object of the present invention to provide method and apparatus which significantly increase the maximum number of selectable brightness levels available over a predetermined range while utilizing a fixed frequency clock.

DESCRIPTION OF THE PREFERRED EMBODIMENT

Figure 1:
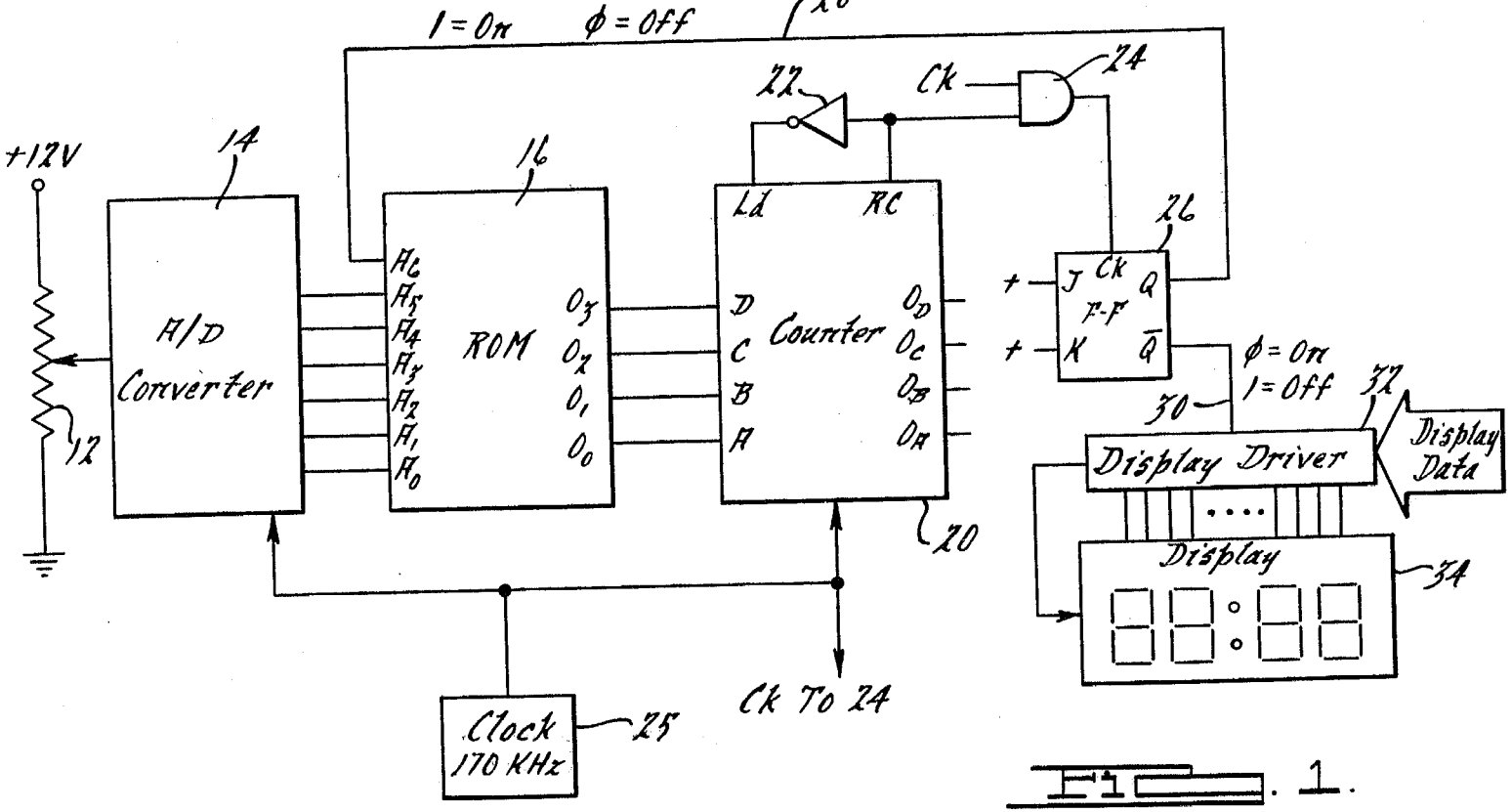
FIG. 1 is a block diagram illustrating the preferred embodiment of the present invention.

The embodiment of the present invention is intended to be incorporated on an automotive vehicle utilizing vacuum fluorescent type electronic displays. However, it is clear that its usage is not so limited.

A conventional potentiometer 12 is employed by the operator to adjust the brightness of the display 34. The potentiometer 12 is adjustable over a linear range of resistance and the analog voltage is fed to an analog to digital converter 14 which produces a digital address signal having a value corresponding to the value of the analog voltage. In this instance, the output of the analog to digital converter 14 is shown on six output lines which are then fed to a programmed read only memory (ROM) 16 on terminals $A_0$–$A_5$. The ROM 16 is an Intel 2716 and is programmed to read out an ON time period value and an OFF time period value of a selected duty cycle for each brightness level that is distinguishable by the analog to digital converter 14 as it senses the analog voltage from the potentiometer 12.

In this instance, the ROM 16 is programmed in accordance with the following table so as to produce duty cycle values which, when plotted over the entire linear range of adjustment of the potentiometer 12 into 64 distinct steps will give a non-linear step function of brightness levels that will be deemed to be linear by a human eye.

TABLE

| NO. | CKS ON | CKS OFF | DUTY FACTOR |
|---|---|---|---|
| 1 | 16 | 1 | .9412 |
| 2 | 9 | 1 | .9000 |
| 3 | 13 | 2 | .8667 |
| 4 | 14 | 3 | .8235 |
| 5 | 15 | 4 | .7895 |
| 6 | 3 | 1 | .7500 |
| 7 | 13 | 5 | .7222 |
| 8 | 9 | 4 | .6923 |
| 9 | 2 | 1 | .6667 |
| 10 | 12 | 7 | .6316 |
| 11 | 14 | 9 | .6087 |
| 12 | 11 | 8 | .5789 |
| 13 | 5 | 4 | .5555 |
| 14 | 9 | 8 | .5294 |
| 15 | 16 | 15 | .5161 |
| 16 | 15 | 16 | .4839 |
| 17 | 7 | 8 | .4667 |
| 18 | 4 | 5 | .4444 |
| 19 | 3 | 4 | .4286 |
| 20 | 11 | 16 | .4074 |
| 21 | 7 | 11 | .3889 |
| 22 | 7 | 12 | .3684 |
| 23 | 5 | 9 | .3571 |
| 24 | 8 | 15 | .3478 |
| 25 | 1 | 2 | .3333 |
| 26 | 5 | 11 | .3125 |
| 27 | 3 | 7 | .3000 |
| 28 | 2 | 5 | .2857 |
| 29 | 3 | 8 | .2727 |
| 30 | 5 | 14 | .2632 |
| 31 | 1 | 3 | .2500 |
| 32 | 5 | 16 | .2381 |
| 33 | 3 | 10 | .2307 |
| 34 | 2 | 7 | .2222 |
| 35 | 4 | 15 | .2105 |
| 36 | 1 | 4 | .2000 |
| 37 | 3 | 13 | .1875 |
| 38 | 2 | 9 | .1818 |
| 39 | 3 | 14 | .1765 |
| 40 | 1 | 5 | .1667 |
| 41 | 3 | 16 | .1579 |
| 42 | 2 | 11 | .1538 |
| 43 | 1 | 6 | .1478 |
| 44 | 1 | 6 | .1428 |
| 45 | 2 | 13 | .1333 |
| 46 | 1 | 7 | .1250 |
| 47 | 1 | 7 | .1250 |
| 48 | 2 | 15 | .1176 |
| 49 | 1 | 8 | .1111 |
| 50 | 1 | 8 | .1111 |
| 51 | 1 | 9 | .1000 |
| 52 | 1 | 9 | .1000 |
| 53 | 1 | 10 | .0909 |
| 54 | 1 | 10 | .0909 |
| 55 | 1 | 11 | .0833 |
| 56 | 1 | 11 | .0833 |
| 57 | 1 | 12 | .0769 |
| 58 | 1 | 12 | .0769 |
| 59 | 1 | 13 | .0714 |
| 60 | 1 | 13 | .0714 |
| 61 | 1 | 14 | .0667 |
| 62 | 1 | 15 | .0625 |
| 63 | 1 | 15 | .0625 |
| 64 | 1 | 16 | .0588 |

The read out data of the ROM 16 is present on output terminals $O_0$–$O_3$. This digital value is input to a counter 20, which is a type SN 74163 supplied by Texas Instruments, Inc. The output of the ROM 16 preloads the counter 20 to a particular value and allows the counter to count clock pulses from a fixed frequency clock source 25 and produce a ripple carry output signal "RC". The ripple carry output signal has two functions. It enables an AND gate 24 to pass a clock pulse that toggles a bistable flip flop circuit 26. In this example, a type 112 flip flop circuit from Texas Instruments, Inc. is employed.

A second function of the ripple carry output signal is to instruct a loading of a counter 20 through an inverter 22, such as a type 04 from Texas Instruments, Inc., to accept load data input at terminals A, B, C and D.

The Q output of the flip flop circuit 26 is fed back to the $A_6$ address input of the ROM 16 as the most significant bit of the address input. Therefore, the digital address signal supplied by the analog to digital converter 14 is constant for a particular setting of the potentiometer 12 while the most significant digit of the address input changes from the ON cycle to the OFF cycle to thereby cause a different data output to be loaded into the counter 20, for each of those portions of a full display cycle.

Figure 2:
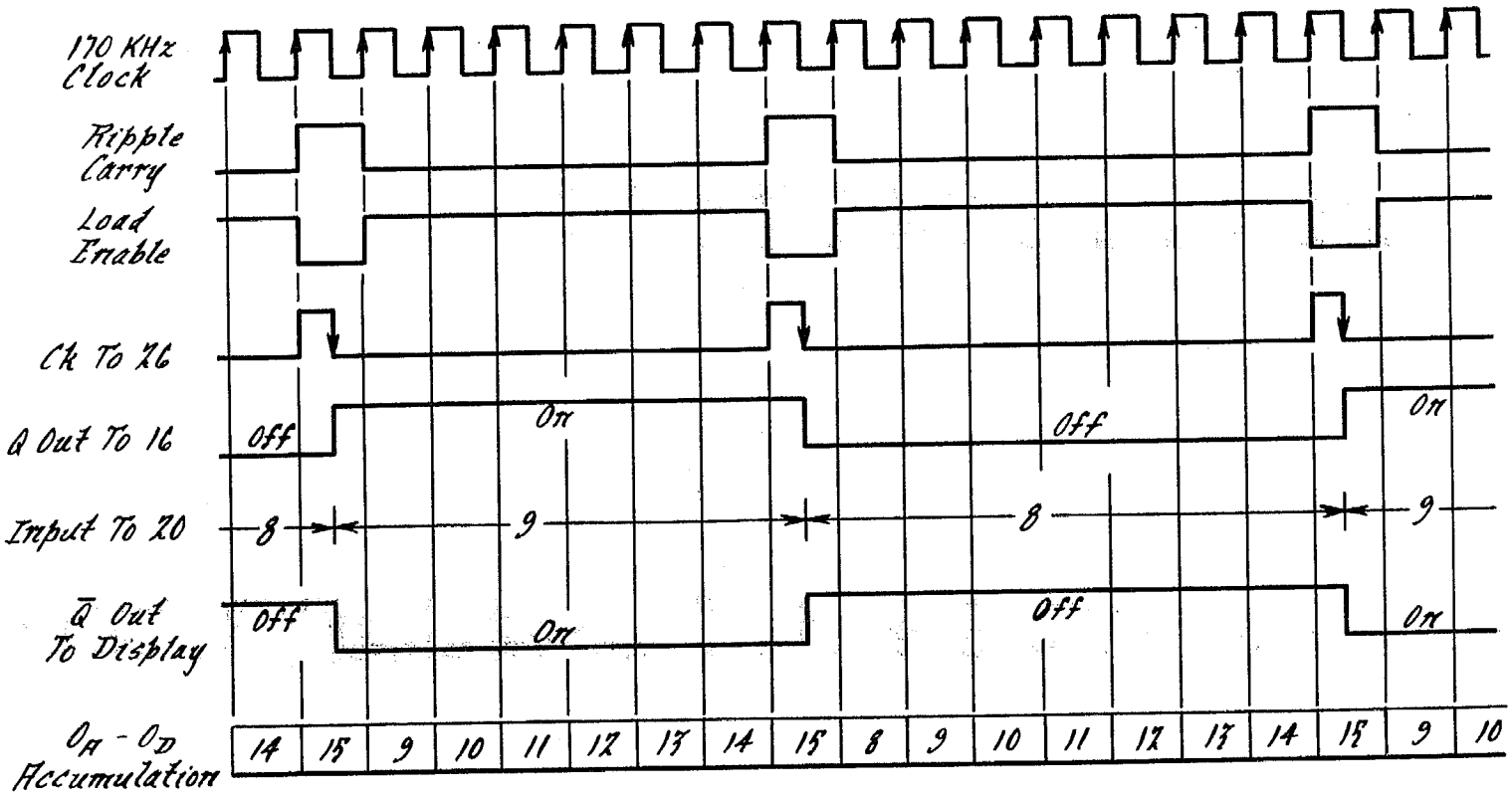
FIG. 2 is a time plot of various waveforms present in the preferred embodiment shown in FIG. 1 for a preselected duty cycle.

The waveforms of FIG. 2 are plotted over time, to indicate the various signals present in this embodiment, when the potentiometer 12 is set at a particular point. As an example, I have selected a point that corresponds to the 50th level of brightness as programmed into the system from the Table. Referring to the Table, it is found that, for the particularly selected non-linear brightness profile, the 17th brightness level step requires a duty factor of 0.4667. Accordingly, to obtain that particular duty factor, the display must be activated for 7 clock pulses and deactivated for 8 clock pulses. When the counter 20 produces a ripple carry output, it extends for a period of time limited by the occurrence of two positively increasing portions of two adjacent clock pulses (second waveform line of FIG. 2). The load enable signal (third waveform line of FIG. 2) is concurrently generated through the inverter 22 and input to the counter 20. During the period of the load enable signal, a positively decreasing portion of the clock pulse (fourth waveform line of FIG. 2) occurs which toggles the flip flop circuit 26 to produce the $A_6$ ON address bit to ROM 16 (fifth waveform line of FIG. 2). The change of the $A_6$ address bit causes the ROM 16 to read out a new value which will preload the various counting registers of the counter 20 to a count of 9 (indicated on the sixth line of FIG. 2). With the preload count of 9, the counter 20 will generate another ripple carry signal after the occurrence of 7 more positively increasing portions of corresponding clock pulses.

Upon the preload of the counter 20, the occurrence of the next postively increasing portion of a clock pulse changes the accumulation value from 15 to 9 (eighth waveform line of FIG. 2). Although the accumulation output signals are not utilized in this embodiment, their values are shown for clarity.

During the occurrence of the changing Q output signal from flip flop circuit 26, the correspondingly opposite Q signal is switched and fed to a display drive circuit 32 on line 30 to cause activation of the display 34 during the occurrence of a 0 level signal (seventh waveform line of FIG. 2). The display driver 32 controls the grid of the vacuum pulse of display 34 for the period of time that the 0 level signal occurs on line 30. Display data information is also fed into the display driver in a conventional matter so that appropriate portions of display 34 may be activated during the ON time activation period.

When the counter 20 reaches its 15th count accumulation, the ripple carry signal is again generated. The counter 20 is load enabled to await the positively decreasing portion of that clock pulse to occur. Upon that occurrence, the flip flop circuit 26 is again toggled so that the $A_6$ address bit is fed along line 28 from the Q output. At that point, the ROM 16 has a changed output data that preloads the counter 20 to a value of accumulated counts. Concurrently, with the generation of the Q output signal, from the flip flop circuit 26, the Q output signal is simultaneously changed to inhibit the display driver 32 from activating the display 34. The display driver 32 remains inhibited for 9 more occurrences of positively increasing portion of the next 9 clock pulses.

Of course, the ON period and the OFF period combine to equal a single display cycle. The present invention allows for different cycle display periods, as necessitated to obtain the correspondingly different duty cycle, which is the relationship of the number of ON clock pulses as compared to the total display cycle.

It will be apparent that many modifications and variations may be effected without departing from the scope of the novel concept of this invention. Therefore, it is intended by the appended claims to cover all such modifications and variations which fall within the true spirit and scope of the invention.

We claim:

1. A method of adjustably activating an electronic display for selected display cycle periods defined by correspondingly selected ON time periods of activation in combination with correspondingly selected OFF time periods of deactivation to control the brightness level of an electronic display over a predetermined pattern of brightness levels, comprising the steps of:

providing a control voltage having a value selected from a predetermined range of voltage values;

converting the selected value of said control voltage to one of a plurality of digital signals respectively corresponding to a separate predesignated portion of said range;

converting said correspondingly selected digital signal to a predesignated one of a plurality of first digital signals having a value corresponding to an ON time period for which said display is to be activated out of each defined display cycle period;

activating said display for a period of time corresponding to said first digital signal value for each display cycle;

converting said correspondingly selected digital signal to a predesignated one of a plurality of second digital signals having a value corresponding to an OFF time period for which said display is to be deactivated out of each defined display cycle period; and deactivating said display for a period of time corresponding to said second digital signal value for each display cycle.

2. An apparatus for adjustably activating an electronic display for selected display cycle periods defined by correspondingly selected ON time periods of activation in combination with corresponding selected OFF time periods of deactivation to control the brightness level of an electronic display, comprising:

means for providing a control voltage having a value selected from a predetermined range of voltage values;

means for converting the selected value of said control voltage to one of a plurality of digital signals respectively corresponding to a separate predesignated portion of said range;

means for converting said correspondingly selected digital signal to a predesignated one of a plurality of first digital signals having a value corresponding to an ON time period for which said display is to be activated out of each defined display cycle period;

means for activating said display for a period of time corresponding to said first digital signal value for each display cycle;

means for converting said correspondingly selected digital signal to a predesignated one of a plurality of second digital signals having a value corresponding to an OFF time period for which said display is to be deactivated out of each defined display cycle period; and means for deactivating said display for a period of time corresponding to said second digital signal value for each display cycle.

3. An apparatus as in claim 2, wherein said control voltage supply means includes a continuously variable potentiometer connected across a relatively stable voltage source to provide said control voltage as an analog function of the setting of said potentiometer; and said control voltage converting means includes an analog to digital converter circuit which outputs said digital signals.

4. An apparatus as in claim 3, wherein said means for converting said selected digital signal includes a programmed memory which provides said first and second digital signals in response to a selected digital signal being applied as an address thereto.

5. In combination:

an electronic display means for responsively generating informational signals in the form of visible electromagnetic radiation; and means for selecting and controlling the brightness level of said visible radiation generated by said display means over a predetermined non-linear range of brightness levels, wherein said selecting and controlling means includes:

a continuously variable means for selecting an analog voltage over a predetermined linear range of voltages;

means connected to said analog voltage selecting means for converting said analog voltage to a digital signal having a value according to a preselected step pattern of said non-linear brightness level range;

means responsive to said digital signal for alternately activating and deactivating said display for respectively predetermined time periods within a correspondingly selected display cycle period defined by said activating and deactivating time priods selected according to said digital signal value.

* * * * *